United States Patent [19]

Flinn

[11] 4,197,649

[45] Apr. 15, 1980

[54] LINEAR MARKING DEVICE

[76] Inventor: Joseph B. Flinn, General Delivery, Troy, Ohio 45373

[21] Appl. No.: 927,407

[22] Filed: Jul. 24, 1978

[51] Int. Cl.[2] ..... B43L 7/00; B43L 13/00

[52] U.S. Cl. ..... 33/488; 33/32 R

[58] Field of Search ..... 33/32 R, 32 B, 32 C, 33/32 F, 107 R

[56] References Cited

U.S. PATENT DOCUMENTS

| | | | |
|---|---|---|---|
| 185,102 | 12/1876 | Hays | 33/107 R |
| 556,582 | 3/1896 | Maier | 33/107 R |
| 2,016,985 | 10/1935 | Carlson | 33/107 R |
| 2,736,097 | 2/1956 | Coleman | 33/107 R |
| 2,908,081 | 10/1959 | Burke | 33/107 R |
| 3,178,826 | 4/1965 | Aisen | 33/32 B X |
| 3,439,426 | 4/1969 | Wilson | 33/32 B |

FOREIGN PATENT DOCUMENTS

| | | | |
|---|---|---|---|
| 482074 | 6/1953 | Italy | 33/107 R |
| 355886 | 9/1931 | United Kingdom | 33/107 R |

*Primary Examiner*—Charles E. Phillips

*Attorney, Agent, or Firm*—Roy, Kiesel, Patterson & Abadie

[57] ABSTRACT

A linear marking device is provided comprising a ruled straight edge having transparent properties and constructed with a marking implement groove and unique surface gripping strip.

7 Claims, 9 Drawing Figures

LINEAR MARKING DEVICE

BACKGROUND OF THE INVENTION

1. Field of the Invention

This invention relates generally to linear marking devices and, more particularly, to linear marking devices designed to facilitate visual scanning of a surface of paper or the like while simultaneously and discretionately drawing lines on the same surface.

2. Prior Art

Inscribing a line or mark on paper, wood or the like by using a straight-edge as a guide for the scribing implement has been practiced for many centures and during this period, many changes and improvements in both straight-edge devices and writing apparatus have been made. For example, straight-edges can be ruled in various increments and can be composed of a wide array of substances which might be transparent, translucent or opaque. Also, writing implements are available in widely diverse styles with many kinds of tips. Different types of improved straight-edge instruments designed to be used in whole or in part as linear guides for marking or writing tools are found in U.S. Israel Pat. No. 2,607,992 issued Aug. 26, 1952, entitled "Scribing Assembly"; U.S. Baukus Pat. No. 2,957,390 issued Oct. 25, 1960, entitled "Book Liner and Magnifier"; and U. S. Whitmore Pat. No. 2,057,807 issued Oct. 20, 1936, entitled "Magnifying Device". Likewise, various transparent materials of a curved nature (magnifying lens) have been used for a long time to scan text, etc. and, at the same time, enhance the field of view. Many changes have occurred in the area of these magnifying-reading devices as well, such as those found in U.S. Bugbee Pat. No. 1,588,442, issued June 15, 1926, entitled "Frame Construction for Magnifying Glasses" and U.S. Coleman, Jr. Pat. No. 2,736,097 issued Feb. 28, 1956, entitled "Magnifying Measuring Scale". In addition, there are magnifying lenses that provide a light source (see U.S. Sakols Pat. No. 2,586,723 issued Feb. 19, 1952, entitled "Illuminated Magnifying Lens") and, at least one patented lens and scribing combination as found in U.S. Brown Pat. No. 2,748,474 issued June 5, 1956, entitled "Combined Scribing and Eye-Protecting Optical System".

While there have been many improvements in linear marking devices, particularly the utilization of magnifying lenses and manifold scribing assemblies, present designs are still not satisfactory for simultaneously scanning or traversing the surface of a text, etc. and scoring lines on the same surface in a fast, convenient and accurate manner. Furthermore, designs to date do not provide an adequate means to mark lines on the surface of the field of view that is being displayed, whether in magnified or in normal or reduced proportion under a transparent medium.

SUMMARY OF THE INVENTION

One object of this invention is to furnish a practical instrument that can utilize the magnifying lens to scan a text and simultaneously facilitate underlining desired portions thereof or otherwise scoring on the surface of the text that is being magnified.

A further object of this invention is to provide a device of the character herein described whereby a line or mark may be inscribed upon paper or the like with the instrument in position; therefore removing the need of supplemental writing or marking implements.

A still further object of this invention is to provide a device of the character herein described in which the particular writing or marking implement being utilized can be easily removed from the device thereby leaving a ruled magnifying instrument which can be used in a conventional fashion.

Another object of this invention is to provide a device of the character herein described which can be used to draw a straight line between two points on a surface while, at the same time, magnifying the displayed field of view of the surface that is under consideration.

A further object of this invention is to provide a device of the character herein described that is designed in such a way as to maximize leverage in the hand grip, thereby enabling the user to traverse the surface of sidebound manuscripts and books or the like with the instrument in an expedient, singular and unobstructed fashion.

Still another object of this invention is to furnish a device of the character herein described that provides a resilient strip which, with the slightest pressure from the hand grip, serves as a sure footing that enables the user to smoothly delineate very slippery surfacing without the instrument sliding out of position.

These and other objects and advantages of this invention will become apparent from the following descriptions of the invention.

Accordingly, a linear marking device is provided comprising a ruled straight-edge of a magnifying nature having a slot that extends lengthwise along the ruled increments (engraved on the underside) and inwardly from the exterior edge of the lens to open on the underside, in which implements of various marking capabilities can be placed or removed from as desired and in which said implements can traverse back and forth, thereby marking straight lines on the surface upon which the entire instrument is situated while either in the motion of scanning or otherwise or at a standstill, thereby enabling the user to view in magnified proportion and discretionately score linear markings on the surface with minimal effort and secure positioning of the instrument purveyed through its contrived features and unique design.

BRIEF DESCRIPTION OF THE DRAWINGS

In the following drawings, the preferred but, obviously, not the only embodiments of the invention are shown.

PREFERRED EMBODIMENTS OF THE INVENTION

Without limiting the scope of the invention, the preferred features of this invention will be described using a device specifically designed to assist magnification of the contents on a surface and simultaneous and discretionate linear marking on the same surface.

In a typical ruled, straight-edge, magnifying apparatus, a convexly arched instrument is provided, composed of transparent materials, such as glass or plastic, and standard incremental demarcations are furnished and, also, a straight-edge that can facilitate testing of straight lines and surfaces or drawing straight lines is purveyed. The design of these apparatus does not permit, however, drawing on the same portion of the surface that is being magnified, while it is being magnified. Since a capabiity such as this might be desirable in numerous situations, a linear marking device, such as seen in FIG. 1, may be used to achieve this and other purposes as will become apparent.

Figures 1, 2:
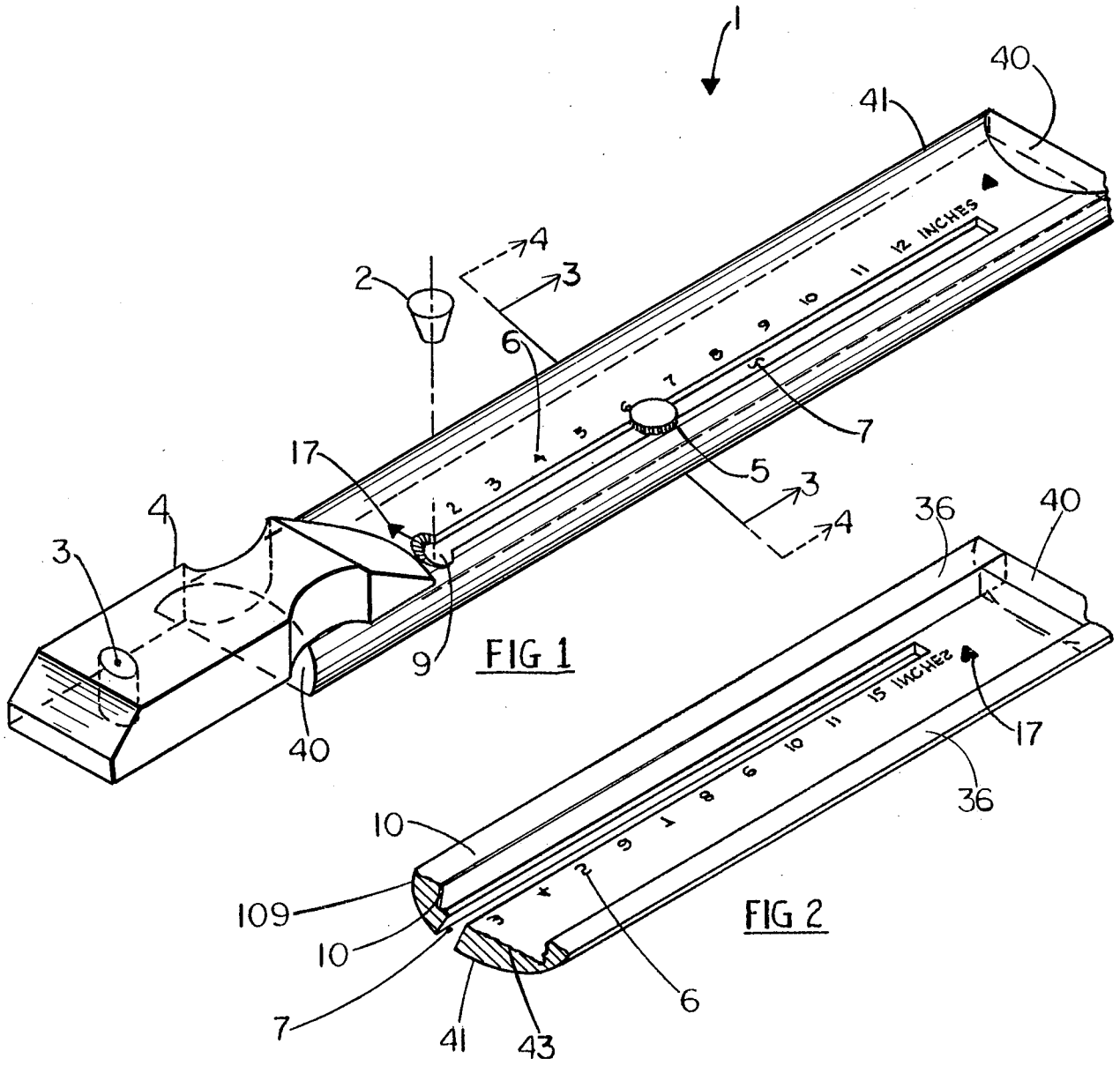
FIG. 1 is a perspective view of the preferred embodiment of the linear marking device of the present invention equipped with one type of marking tool.
FIG. 2 is an inverted view of the preferred embodiment shown in FIG. 1, the handle portion of which has been broken away and in which the tool that was in the slot in FIG. 1 has been removed.

Now, in accordance with this invention, FIGS. 1 and 2 exhibit a ruled 6 magnifying instrument 1, the upper surface 41 of which is arcuate, providing the magnifying properties of this instrument, while the underside is completely circumscribed by shoulders 36 and closed end segments 40 which facilitate the raising of its flat faced area 43 off of any surface being considered by the user of this device, supposing that the instrument of this device is in its usual operative position. As the shoulders of this instrument raise the flat faced area 43 of its underside off of the surface edge, a concavity 46 is provided between said flat faced area and the surface edge, which is best displayed in FIGS. 3, 4 and 5. To reiterate, it is only the bottom edge 109 of the circumscriptive wall around the flat faced area 43 of said underside which is comprised of the shoulders 36 and segments 40 closing the ends that makes contact with the surface considered and not the flat faced area itself. Of course, the bottom edge 109 of this circumscriptive wall is basically smooth and otherwise unabrasive in nature so as to render easy passing of this device across typical surfaces such as paper. The only component of this device that protrudes below the level of the bottom edge 109 of said conscriptive wall is a resilient strip 10 which serves as a secure footing to prevent the device from sliding out of position on the surface considered while the marking tool 5 is being used to traverse the paper or for other obvious reasons. FIGS. 1 and 2 also display a long narrow groove 7 which pierces the magnifying instrument 1 on its upper surface 41 and proceeds through said instrument to penetrate the flat faced area 43 of the underside, thus providing an exact passageway or straight-edged guide along which the marking tool can travel in making accurate linear marks on the surface of the paper, etc. The marking tool 5 can be inserted into and removed from this groove 7 (or slot) via an enlarged opening 9 at the end of the groove which becomes accessable by displacing a plug 2 and then replacing it as deemed necessary for the particular situation. Hence, the means to make linear markings on the surface considered in the same instant that said surface is being magnified is purveyed. Continuing with FIGS. 1 and 2, the handle 4 in this view is attached to the top side of the upper surface of the magnifying instrument and is pierced by a hole 3 for convenient storage and the like. Also, in addition to the inscribed ruled increments 6, other accommodative aids can be afforded such as the arrow shaped pointers 17 which are likewise inscribed on the flat face area of the underside to facilitate alignment of the device with respect to discretionately selected points on a surface in order that a straight line can be drawn between such points as so desired by the user.

Figure 3:
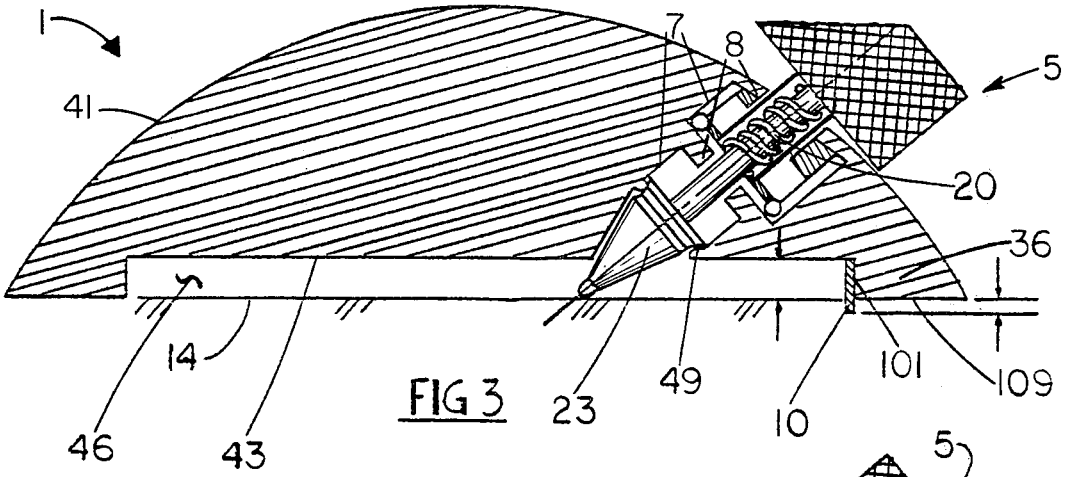
FIGS. 3 and 4 are cross-sectional views taken along lines 3—3 and 4—4, respectively, of FIG. 1 illustrating the marking tool depressed to the paper's edge and the marking tool in normal position, respectively.
Figure 4:
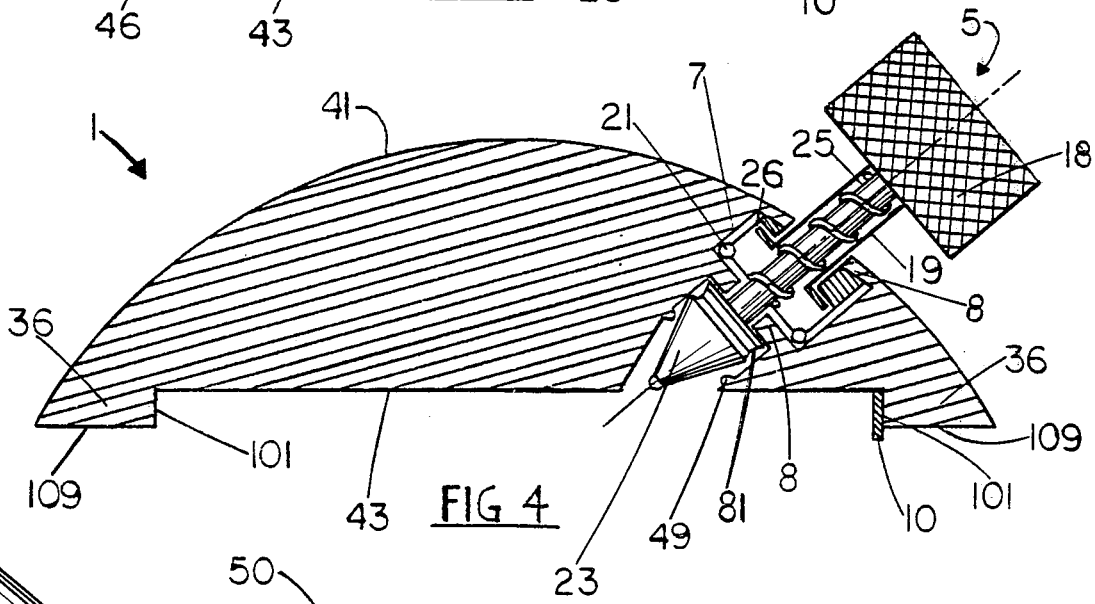

Referring now particularly to FIGS. 3 and 4, these cross-sectional views of a preferred embodiment taken along lines 3—3 and 4—4 of FIG. 1 better display what is taking place as the user of this device discretionately decides to depress the marking tool 5 to the paper's edge 14 to make a line, etc. or to leave it in its normal spring urged position, respectively. In these depictions, it is more clearly shown how the stripping 10, made of rubber or similar materials, protrudes below the level of the bottom edge 109 of the circumscriptive wall of this device which is designed to rest flushly on whatever surface is being considered and/or traversed. This stripping may be made to adhere to the designated area of the magnifying instrument of this device using glue or other means, and when downward pressure is applied to this device during any of the various functions of its utilization, this stripping, due to the nature of its composition, will serve to grab the surface and prevent the device from slipping or sliding out of position. The groove 7 of the transparent magnifying instrument 1 is designed to facilitate all of the components of the preferred selected marking tool 5, which will be thoroughly covered in FIG. 6. Some of the more important components of the groove 7 are the lips 8 which extend out into the central area of the groove and serve to hold the preferred marking tool 5 firmly in the groove, whether it's depressed or in regular position. The spring 20 constantly urges the marking tool upwards against the lips 8 while in regular position, and the downward pressure, exerted when the user depresses the marking tool towards the paper's edge, urges said tool with its various parts downwards against the lips 8, which, likewise, keeps it firmly in place. Other very important components of the preferred embodiment of this groove are the knobbed rails 49 at the base of either side of the groove, which extend the entire length of the groove, and in which the concave lap 81 of the marking tool tip 23 rides and is otherwise securely guided when the user has depressed the marking tool into this position and is moving it in traverse fashion or simply holding it stationary in this position or otherwise.

Figure 5:
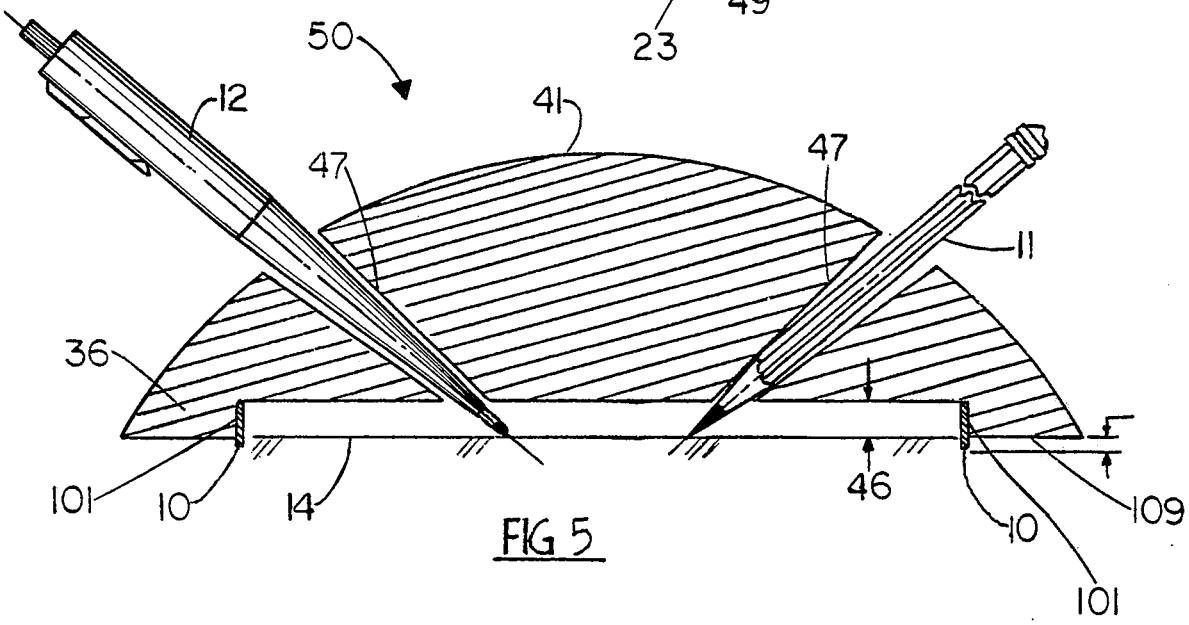
FIG. 5 is a cross-sectional view taken along lines 5—5 of FIG. 8 showing a modification in the slotting and of the line drawing or marking means.

This marking tool 5, as shown in FIGS. 3 and 4, is a rather intricate assembly as compared to the more simple and commonplace marking implements displayed in FIG. 5. Briefly, this tool houses the marking or lining means and can be assembled completely apart from the rest of the embodiment and then slid into place to assume its normal position in the groove as a functional part of the overall device. Likewise, this implement can be removed from the groove of the magnifying instrument as desired. The lining or marking means of this tool can be writing shafts with points comprised of lead, quills, ball points, felts or other marking materials adapted to render a marking when engaged to traverse the surface of paper or the like; whereas, in FIG. 5, the grooving of the magnifying instrument is designed to facilitate the more conventional felt tip and ball point pens and lead pencils, etc. Also, in FIG. 5, the magnifying instrument 50 is grooved on both sides to make allowances for ambidexerity and to demonstrate how grooves of different proportions might be used to facilitate the various conventional marking implements available today.

Figure 8:
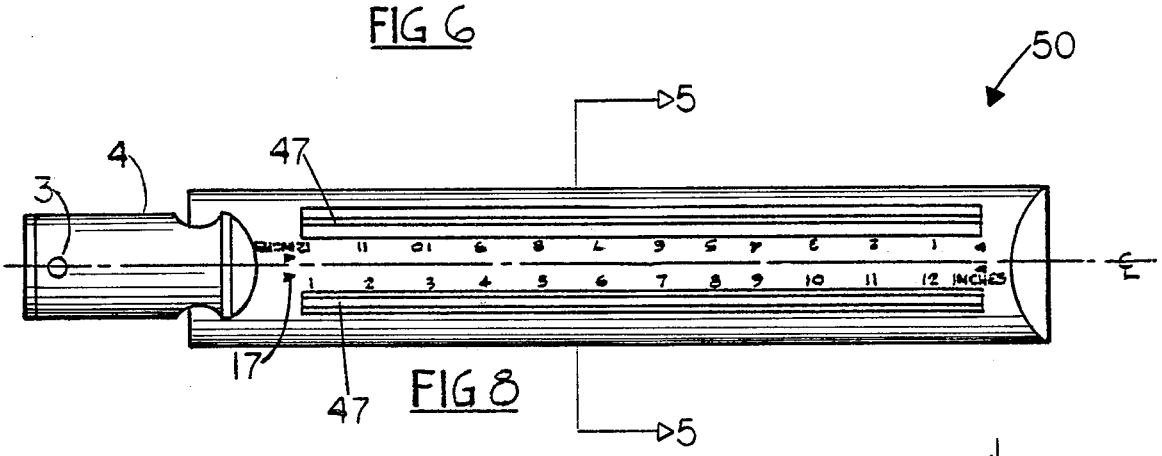
FIG. 8 is a plan view of the modified form of this invention, a cross-section of which is shown in FIG. 5.

In the instrument shown in FIG. 5, which was taken along lines 5—5 of FIG. 8, the grooves 47 are flat and smooth, not having the protuberant lips and uneven fall line that the inner walls of the groove 7 of FIGS. 3 and 4 have. The angle of attack of the grooves 47 in FIG. 5 on the upper surface 41 of their magnifying instrument 50 and their penetration through said instrument is essentially the same as the angulation of the groove 7 in the magnifying instrument 1 shown in FIGS. 3 and 4. Also, the basic purpose of groove 7 and grooves 47 in the magnifying instruments shown in FIGS. 3 and 4 and in FIG. 5, respectively, remains the same. This purpose is to provide a precise passageway which serves to guide the particular marking implement that is being used in connection with this device with functional respect to whatever form said marking implement comprises in order that the marking implement can make accurate linear marks on the surface being considered at the discretion of the user. The particular marking implements shown in the grooves 47 of the magnifying instrument that is displayed in FIG. 5 are a ball point pen 12 and a standard pencil 11.

Again looking at FIGS. 3 and 4, the groove 7 envelopes the marking tool 5 once said tool is properly placed in the groove by way of the enlarged opening 9 at the end of the groove which was mentioned earlier. When the marking tool is in place in the groove, its fluent movement back and forth in the groove is afforded by means of the ball bearings 21 which are situated along the base of sheath 26 through which the writing shaft 25 of the marking tool passes and by which said shaft is held stable. Also in these figures, the concavity 46 between the flat faced area 43 of the underside and the paper's edge 14 is well displayed. Through use of adhesive or other means, the stripping 10 is made to adhere to the flat inside wall 101 of the shoulder 36 that is nearest to the groove 7 of the magnifying instrument 1. As can be seen, this stripping protrudes below the level of the bottom edge 109 of the shoulder 36 and serves to grab the paper's edge 14 when downward pressure is applied to this linear marking device.

In FIG. 5, though the stripping 10 has the same relation to the overall device and serves the same purposeful function, a variation of said stripping 10 is given whereby it is attached to both of the inside walls 101 of the shoulders 36 of the magnifying instrument 50, which allows this embodiment of the linear marking device to be equally functional in either the right-handed or left-handed approach to its utilization and, likewise, facilitates other obvious services that this embodiment of the device might perform.

Figure 6:
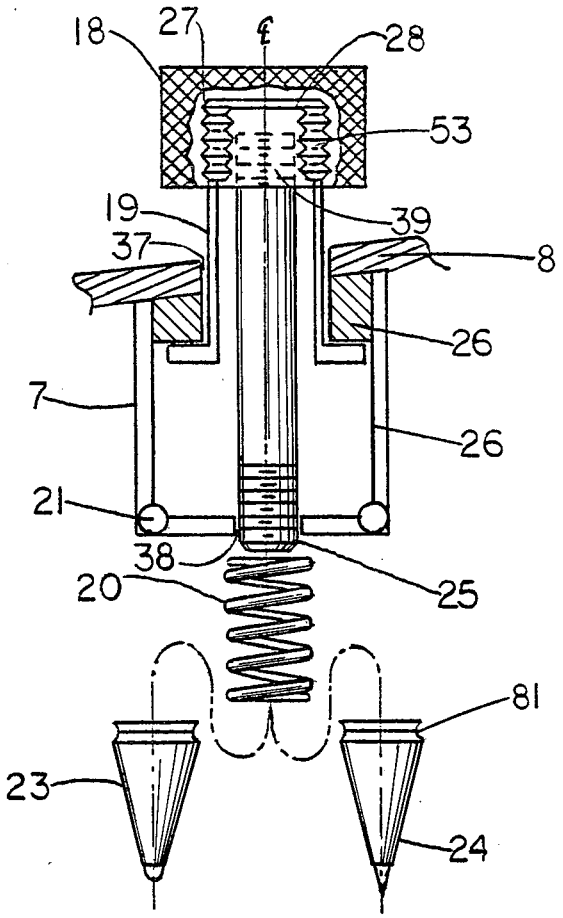
FIG. 6 is an exploded side elevational view of the preferred marking tool of FIGS. 1, 3 and 4 with certain parts shown in broken lines.

In FIG. 6, the preferred embodiment of the marking tool 5, with all of its various components, is more clearly illustrated. Now, an assemblage of this tool can be related. In general terms, the darji component 19 is made up of two posts that broaden in opposite directions at the bottom and that are connected by a cylindrical head 53 which is threaded on the outside 27 and on the inside 28. Firstly, spring 20 is inserted into sheath 26 by way of its top shaft hole 37. Then the cylindrical head 53 of darji component 19 by means of its outer threads 27 screws into the cap 18 which has inner threads only. (This cap 18 can be employed by the user of the device as a grip to manipulate this marking tool). Then the two posts of the darji component 19 are pinched together and fitted through the top shaft hole 37 of the sheath 26, on the other side of which they flex back into their normal position. At this point, writing shaft 25 is inserted up through the bottom shaft hole 38 of the sheath 26 and also through the spring 20 contained therein and its upper threads 39 are screwed into the inner threads 28 of the cylindrical head 53 of the darji component 19. Then the desired marking tip (23 or 24) is screwed on the lower threads 42 of the writing shaft 25. A circumscriptive concave lap 81 is provided around the upper brim of these marking tips, as indicated before, which is designed to catch on the knobbed rails 49 found at the base of either side of the groove 7 of the magnifying instrument 1, whenever this marking tool is depressed into that position. Next, ball bearings or the like 21 are placed in provided cavities 48 found along the bottom of the sheath 26. The whole marking tool, being assembled at this point, can be placed in and displaced from the groove 7 of the magnifying instrument 1 as aforedescribed and the lips 8 that extend into the central area of said groove and that were likewise previously mentioned will, by design, serve to hold this marking tool firmly in place at any particular resting point along this groove. FIG. 6 presents but one example of a preferred combination and assemblage of selected components, most of which are available on the market today, that can be adopted and used in connection with or as a part of this invention.

Figure 7:
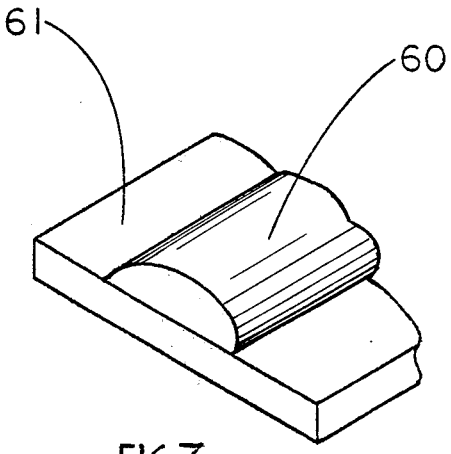
FIG. 7 is a section broken away from a slightly different selected embodiment of this invention.

In FIG. 7, a segment of another possible form of embodiment for part of this invention is displayed in which a curved magnifying structure 60 is situated upon a transparent and broader base 61 than its own.

In FIG. 8, the magnifying instrument portion of this invention furnishes two grooves 47, one along each side, to accommodate ambidexerity in holding and using said device, to serve other obvious functions and so contrived as to readily facilitate the more conventional types of marking implements as was partially displayed in FIG. 5.

Figure 9:
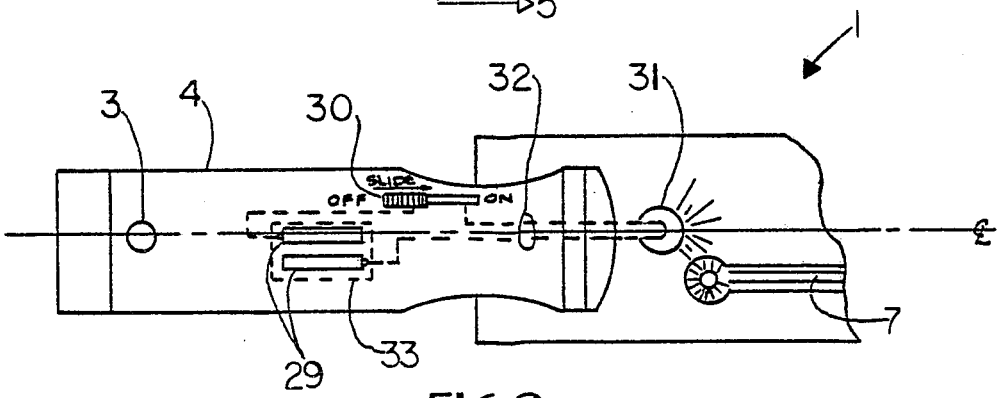
FIG. 9 is a plan view of the embodiment shown in FIG. 1 displaying the addition of a light source with certain parts lined in broken lines.

In FIG. 9, a light source has been added to the preferred embodiment disclosed initially in FIG. 1 of these drawings. The batteries 29 of this particular display are housed in a compartment 33 which is designated by broken lines. The wiring 32 from said batteries is circuited to a slide switch 30 and from there to an incandescent light socket and bulb 31. In this particular display, it is contemplated that the light socket and bulb 31 open into the concavity 46 of the underside of the magnifying instrument so as to make access to and the changing of said bulb an easy task. FIG. 9 is but a preferred example of a possible light source that could be made appurtenant to this invention.

There are, of course, many alternate embodiments of this invention. For instance, by way of example only, changes and modifications of the geometric design of the magnifying instrument, number, size and shape of the grooved portions in the instrument, etc., all of which are meant to be included within the scope of this invention as defined by the following claims.

What I claim is:

1. A linear marking device for use with an implement having a marking element comprising a body constructed of transparent material, said body comprising:

(a). an elongated member having an arcuate upper surface having magnifying characteristics and an opposed planar surface, said opposed planar surface having a recessed flat perimeter area between parallel straight edges, (b). A slot cut through said arcuate surface parallel to said straight edges, and communicating with said recessed flat perimeter area, (c). said flat perimeter area forming a cavity of sufficient depth to allow said marking element when passed through said slot to extend into said cavity to be placed beneath said arcuate surface at a position where it can be magnifiedly seen through said arcuate surface.

2. A linear marking device according to claim 1 wherein a gripping strip constructed from resilient material is attached to said perimeter area.

3. A linear marking device according to claim 2 wherein said resilient strip is rubber.

4. A linear marking device according to claim 1 wherein said slot is rectangular where said slot extends into said cavity.

5. A linear marking device according to claim 4 wherein said slot comprises sloping side walls between said arcuate surface and said cavity.

6. A linear marking device according to claim 4 wherein incremented markings are located adjacent one of the edges of said slot on the bottom surface of said cavity.

7. A linear marking device according to claim 1 wherein said slot has an enlarged opening located at one end of said slot for receiving a marking tool.

* * * * *